US008496054B2

(12) United States Patent
Zazovsky et al.

(10) Patent No.: US 8,496,054 B2
(45) Date of Patent: Jul. 30, 2013

(54) METHODS AND APPARATUS TO SAMPLE HEAVY OIL IN A SUBTERRANEAN FORMATION

(75) Inventors: Alexander Zazovsky, Houston, TX (US); Anthony Goodwin, Sugar Land, TX (US); Jacques R. Tabanou, Houston, TX (US); Kambiz A. Safinya, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 883 days.

(21) Appl. No.: 11/962,857

(22) Filed: Dec. 21, 2007

(65) Prior Publication Data

US 2009/0008079 A1 Jan. 8, 2009

Related U.S. Application Data

(60) Provisional application No. 60/885,250, filed on Jan. 17, 2007, provisional application No. 60/979,697, filed on Oct. 12, 2007, provisional application No. 60/987,267, filed on Nov. 12, 2007.

(51) Int. Cl.
*E21B 49/10* (2006.01)

(52) U.S. Cl.
USPC ..... 166/264; 166/302; 166/100; 166/60

(58) Field of Classification Search
USPC ..... 166/264, 100, 302, 60
See application file for complete search history.

(56) References Cited

U.S. PATENT DOCUMENTS

| | | | | |
|---|---|---|---|---|
| 3,289,474 | A * | 12/1966 | Smith | 73/152.41 |
| 3,722,589 | A * | 3/1973 | Smith et al. | 166/250.01 |
| 3,859,851 | A | 1/1975 | Urbanosky | |
| 4,742,459 | A | 5/1988 | Lasseter | |
| 4,860,581 | A | 8/1989 | Zimmerman et al. | |
| 4,994,671 | A | 2/1991 | Safinya et al. | |
| 5,266,800 | A | 11/1993 | Mullins | |
| 5,377,755 | A | 1/1995 | Michaels et al. | |
| 5,939,717 | A | 8/1999 | Mullins | |
| 6,084,408 | A * | 7/2000 | Chen et al. | 324/303 |
| 6,230,814 | B1 | 5/2001 | Nasr et al. | |
| 6,755,246 | B2 * | 6/2004 | Chen et al. | 166/250.01 |
| 7,032,661 | B2 * | 4/2006 | Georgi et al. | 166/250.01 |
| 7,115,847 | B2 * | 10/2006 | Kinzer | 219/772 |
| 2003/0145987 | A1 | 8/2003 | Hashem | |
| 2004/0093937 | A1 * | 5/2004 | Hashem | 73/152.24 |
| 2005/0199386 | A1 | 9/2005 | Kinzer | |
| 2008/0066534 | A1 * | 3/2008 | Reid et al. | 73/152.11 |
| 2008/0066904 | A1 * | 3/2008 | Van Hal et al. | 166/250.1 |
| 2009/0211752 | A1 * | 8/2009 | Goodwin et al. | 166/250.02 |

FOREIGN PATENT DOCUMENTS

| | | | |
|---|---|---|---|
| GB | 2431673 A | * | 5/2007 |
| WO | WO02070864 | | 9/2002 |

* cited by examiner

*Primary Examiner* — Giovanna Wright
*Assistant Examiner* — Robert E Fuller
(74) *Attorney, Agent, or Firm* — John Vereb

(57) ABSTRACT

A method for sampling fluid in a subterranean formation includes, reducing a viscosity of a fluid, pressurizing a portion of the subterranean formation and collecting a fluid sample. Specifically, a viscosity of a fluid in a portion of the subterranean formation is reduced and a portion of the subterranean formation is pressurizing by injecting a displacement fluid into the subterranean formation. A sample of the fluid pressurized by the displacement fluid is then collected.

8 Claims, 12 Drawing Sheets

METHODS AND APPARATUS TO SAMPLE HEAVY OIL IN A SUBTERRANEAN FORMATION

RELATED APPLICATIONS

This patent claims priority from U.S. Patent Application No. 60/885,250, which was filed on Jan. 17, 2007, U.S. Patent Application No. 60/979,697, which was filed on Oct. 12, 2007, and U.S. Patent Application No. 60/987,267, which was filed on Nov. 12, 2007. U.S. Patent Application Nos. 60/885,250, 60/979,697, and 60/987,267 are hereby incorporated by reference in their entireties.

FIELD OF THE DISCLOSURE

This disclosure relates generally to subterranean formation fluid sampling and, more particularly, to methods and apparatus to sample heavy oil in a subterranean formation.

BACKGROUND

One technique utilized in exploring a subterranean formation involves obtaining samples of formation fluid downhole. Tools such as the MDT and CHDT (trademarks of Schlumberger) are extremely useful in obtaining and analyzing such fluid samples. Tools such as the MDT (see, e.g., U.S. Pat. No. 3,859,851 to Urbanosky, and U.S. Pat. No. 4,860,581 to Zimmerman et al., which are hereby incorporated by reference in their entireties) typically include a formation interface such as fluid entry port or tubular probe cooperatively arranged with one or more wall-engaging packers, which isolate the formation interface (e.g., inlet port or sample probe) from borehole fluids and/or other contaminants. Such tools also typically include one or more sample chambers, which are coupled to the formation interface by a flowline having one or more control valves arranged therein, means for controlling a pressure drop between the formation pressure and sample chamber pressure, and various sensors such as pressure sensors, temperature sensors, and/or optical sensors to obtain information relating to the sampled fluids.

Optical sensors may be provided using, for example, an OFA, CFA or LFA (all trademarks of Schlumberger) module (see, e.g., U.S. Pat. No. 4,994,671 to Safinya et al., U.S. Pat. No. 5,266,800 to Mullins, and U.S. Pat. No. 5,939,717 to Mullins, all of which are hereby incorporated by reference in their entireties) to determine the composition of the sample fluids. The CHDT is similar in many respects to the MDT, but includes a mechanism for perforating a casing such as a drilling mechanism. An example of such a drilling mechanism may be found in "Formation Testing and Sampling through Casing," *Oilfield Review*, Spring 2002, which is incorporated by reference in its entirety. However, tools such as the MDT and CHDT are typically used to obtain samples of formation oil having relatively low viscosities (e.g., typically up to 30 mPa·s). While such tools have been used to sample higher viscosity fluids, the sampling process often requires several adaptations and many hours.

As global reserves of light crude oil are diminished, the exploration of heavy oil and bitumen has become more important to maintain global supply. When evaluating heavy oil or bitumen formations, it is advantageous to obtain representative samples of the formation to determine appropriate production methods. However, due to the low mobility of heavy oil and bitumen, sampling these formations can be difficult or impossible using many known light crude oil sampling techniques.

Attempting to sample a heavy oil or bitumen, for example, without first increasing the mobility of these fluids can result in excessive drawdown pressures, which can cause failure of a pump or pumpout unit being used to extract the fluid, failure (e.g., cracking, fracturing, and/or collapse) of the formation, and/or phase changes and, thus, compositional changes to the fluid being sampled. Further, such excessive drawdown pressures can lead to the production of sand, which may cause failure of sampling tool seals. While increasing the areas of the sampling ports or probes can reduce the drawdown pressures somewhat, larger port or probe areas can be difficult to achieve without adversely impacting overall size of the sampling tool and the ability to achieve an effective seal around the sampling ports or probes.

One factor contributing to the low mobility of heavy oil and bitumen formations is the high viscosity of these fluids. Therefore, substantially reducing the viscosity of the heavy oil and bitumen in the formations can help increase mobility sufficiently to obtain a sample. Some known methods to increase the mobility of formation fluid involve heating the formation through a variety of means, injecting a diluent into the formation, or injecting a solvent into the formation.

Heating a formation has typically been accomplished by thermal conduction using a heating element, in situ combustion of some of the oil in the formation, circulation of hot steam into the formation. However, these known methods rely primarily on the thermal conduction of the formation and, thus, the volume of the formation that must be heated is often much greater than the volume being sampled, leading to long sampling times and a greater probability of the sampling tool becoming trapped in the wellbore.

SUMMARY

An example method for sampling fluid in a subterranean formation involves producing heat in a portion of the subterranean formation by one of an ohmic heating and a dielectric heating. The example method also pressurizes the heated portion of the subterranean formation by injecting a displacement fluid into the heated portion of the subterranean formation via at least one of a plurality of formation interfaces, and collects a sample of fluid mobilized by the displacement fluid from the heated portion of the subterranean formation via at least one of the plurality of formation interfaces.

An example apparatus to sample fluid from a subterranean formation includes a formation interface to be hydraulically coupled to the subterranean formation, at least one of a plurality of electrodes and a coil to produce heat in a portion of the subterranean formation by one of an ohmic heating and a dielectric heating, and a collection container to hold a fluid sample extracted from the subterranean formation. The example apparatus also includes a pressurization device to inject at least some of the displacement fluid into the subterranean formation to urge the fluid sample toward the collection container.

Another example method for sampling fluid in a subterranean formation, includes heating a portion of the subterranean formation, pressurizing the heated portion of the subterranean formation by injecting a displacement fluid into the subterranean formation, and collecting a sample of fluid mobilized by the displacement fluid.

Another example apparatus to sample fluid from a subterranean formation includes a formation interface that is hydraulically coupled to the subterranean formation, a heater configured to provide heat to a portion of the subterranean formation, a collection container to hold a fluid sample extracted from the subterranean formation via the formation interface, and a pressurization device to inject a displacement fluid into the subterranean formation to urge the fluid sample toward the collection container.

Yet another example method for sampling fluid in a subterranean involves reducing a viscosity of a fluid in a portion of the subterranean formation, pressurizing the portion of the subterranean formation having the reduced viscosity fluid by injecting a displacement fluid into the subterranean formation, and collecting a sample of the fluid pressurized by the displacement fluid.

DETAILED DESCRIPTION

Figure 1A:
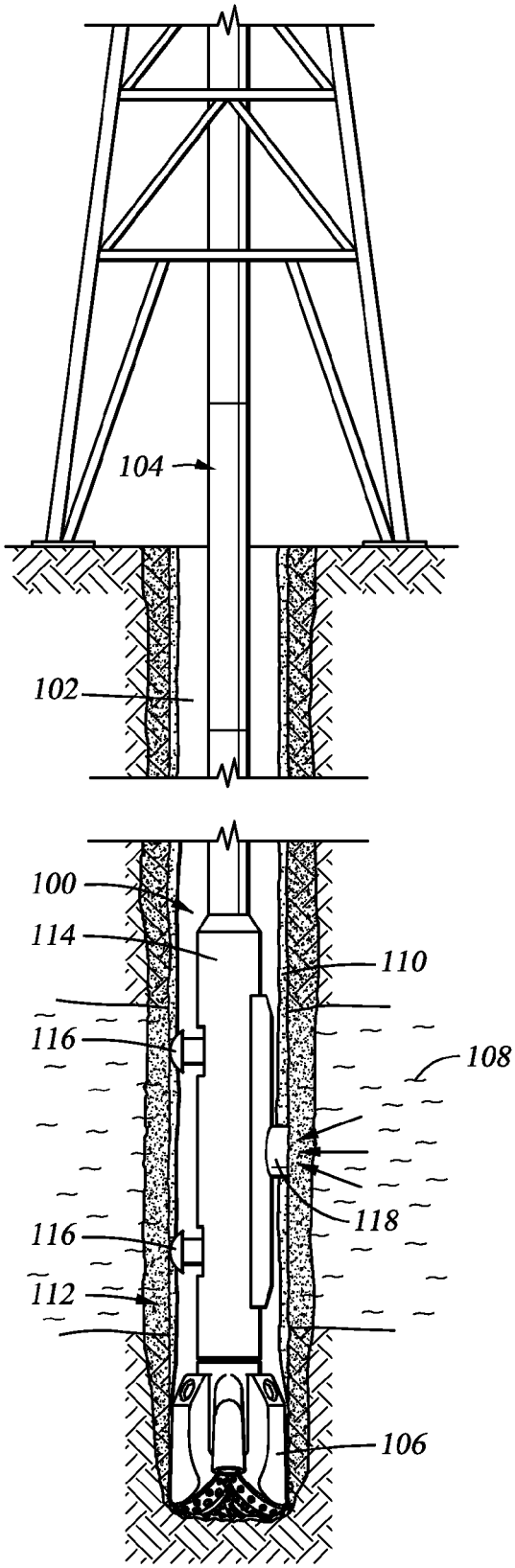
FIG. 1A depicts an example downhole drilling tool deployed from a rig into a wellbore.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example methods and apparatus described herein may be used to sample fluids in a subterranean formation. More specifically, the example methods and apparatus described herein may be particularly useful in sampling relatively viscous subterranean formation fluids such as heavy oil and bitumen. As noted above, some known methods of sampling heavy oil, bitumen, and/or other relatively viscous subterranean formation fluids rely primarily on conductive heating of a formation from which samples are to be extracted. However, relying primarily on conductive heating typically may result in having to heat a formation volume that is many times larger than the volume of sample fluid desired. Further, such conductive heating-based approaches are relatively time consuming and may require many hours to sufficiently heat a formation volume to be sampled. Thus, the example methods and apparatus described herein may preferably, but not necessarily, be used to heat a portion of a subterranean formation to be sampled by generating or producing heat directly in the formation. As a result, a given volume of a formation to be sampled can be heated substantially more quickly than possible with the known conductive heating-based approaches noted above. However, other methods of heating may also be used, and include, but are not restricted to, applying a hot pad against the formation, providing a hot fluid downhole, and the like.

More particularly, the heat may be produced in the formation by flowing an electric current in the portion of the formation, thereby directly heating the portion of the formation. In other words, the example methods and apparatus described herein may rely primarily on ohmic or Joule heating (the generated current dissipates electrical energy as heat in the resistivity of the formation) to heat a portion of a subterranean formation to be sampled. The electric current may be produced by electrostatic or galvanic processes via a plurality of electrodes, or by inductive or magnetic processes with at least one coil. Alternatively, the heat may be produced in the formation by dielectric heating, or microwave heating of the molecules in the formation.

In addition, the example methods and apparatus described herein may use a buffer or displacement fluid (that may also serve as a solvent or diluent) to facilitate mobilization of fluid to be sampled in a heated portion of a subterranean formation. More specifically, the example methods and apparatus described herein may first flow currents in a portion of a subterranean formation from which sample fluid is to be extracted, thereby heating and, thus, reducing the viscosity of the formation fluid in the portion of the formation. When the fluid to be sampled has been sufficiently heated (e.g., based on a detected viscosity of the heated fluid, detection of a mobility change associated with the heated portion of the formation, etc.), the example methods and apparatus may inject the buffer or displacement fluid into the heated portion of the formation. The injected buffer or displacement fluid penetrates the heated portion of the formation and pressurizes the heated formation fluid therein to facilitate mobilization of the heated formation fluid and urge the fluid toward a formation interface that is sampling the formation fluid. The sampling process may be ended prior to any buffer or displacement fluid entering the formation interface (e.g., sampling port or probe) that is extracting the sample of heated formation fluid.

The use of the buffer or displacement fluid to pressurize the heated formation fluid substantially reduces the drawdown pressure (i.e., enables the use of a higher sampling pressure) needed to extract formation fluid samples as compared to known formation fluid sampling techniques that are based primarily on conductive formation heating. As a result, the example formation fluid sampling apparatus and methods described herein substantially reduce the likelihood of changing the phase and/or composition of the fluid being sampled.

The reduced drawdown pressure used with the example sampling methods and apparatus described herein also reduces the likelihood of formation collapse or other formation damage and/or damage to the pumpout used to extract the formation fluid sample.

In some examples described herein, an apparatus for establishing fluid communication with a subterranean formation and to sample a fluid therefrom includes a heat source to increase a temperature of a portion of the subterranean formation. The heat source may be implemented using a plurality of electrodes that are electrically coupled to the subterranean formation, or at least one induction coil. In some examples, the electrodes penetrate a mudcake lining of a wellbore wall to make electrical contact with the formation and an alternating current or direct current voltage is applied to the electrodes to flow current in the portion of the formation. However, mudcake penetration is not required if the wellbore fluid and the mudcake are sufficiently conductive. The generated current dissipates energy as heat across the resistivity of the formation.

In some example implementations, the current-generating electrodes are integral with formation interfaces for sampling or producing formation fluid and/or formation interfaces for injecting a buffer or displacement fluid into a heated portion of a subterranean formation. In other example implementations, the current generating electrodes are separate from the formation interfaces and may be disposed between the formation interfaces. Various electrode geometries such as, for example concentric rings, polygons, etc. may be employed with or within focusing electrodes to achieve a desired current path and/or distribution in the portion of the formation to be heated.

The example formation interfaces described herein may include a first flowline, sampling probe or barrel, and/or the like to be fluidly coupled to the formation to be sampled and a second flowline, injection probe or barrel, and/or the like to be fluidly coupled to the formation to be sampled. A pump, pumpout, etc. and a collection container may be fluidly coupled to the first flowline, sampling probe or barrel, etc. to extract and hold fluid samples taken from the heated portion of formation. A pressurization device (e.g., a pump, piston, etc.) and a fluid container holding a buffer or displacement fluid may be fluidly coupled to the second flowline, injection probe or barrel, and/or the like to enable at least some of the displacement fluid to be injected into a heated portion of the subterranean formation to urge a sample of the heated formation fluid toward the first flowline and into the collection container.

The example methods and apparatus described herein may also use a controller to initiate injection of buffer or displacement fluid into the heated portion of the subterranean formation in response to detecting a merging of heated volumes of the portion of the subterranean formation. Such merging may be detected based on a change in pressure pulse transmission across the heated portion of the formation. For example, a pressure interference test across the heated portion of the formation may be indicative of a merging of heated volumes. Alternatively or additionally the example methods and apparatus may employ viscosity measurement unit such as, for example, a nuclear magnetic resonance unit or module to detect a viscosity of fluid in the heated portion of the formation. Thus, when the detected viscosity reaches a sufficiently low value, the buffer or displacement fluid may be injected to facilitate mobilization of the heated formation fluid.

The controller may additionally or alternatively be used to control the manner in which the electrodes are used to heat a portion of a formation to prevent overheating the formation, which may damage the formation fluid to be sampled. In particular, the controller may sense a temperature of the formation and, in response to detecting a temperature exceeding a predetermined threshold temperature, may cease heating the formation until the sensed temperature falls below the threshold.

While the example methods and apparatus are depicted with formation interfaces for hydraulic coupling to the formation implement with probes or barrels, one or more formation interface may alternatively be implemented using inflatable straddle packers surrounding an inlet. Further, one or more formation interface may optionally comprise a perforating mechanism.

Now turning to FIG. 1A, an example downhole drilling tool 100 deployed from a rig into a wellbore 102 is shown. The example downhole drilling tool 100 may be configured to implement the example formation fluid sampling methods and apparatus described herein. The drilling tool 100 is deployed on a drillstring 104 and has a bit 106 used to drill into the earth and into a subterranean formation 108 to form the wellbore 102. As the drilling tool 100 penetrates deeper into the subterranean formation 108, drilling mud (not shown) lines the wall of the wellbore 102 to form a mudcake 110. Additionally, some of the drilling mud penetrates into the subterranean formation 108 through the wall of the wellbore 102 to form an invaded zone 112, contaminating some virgin fluid contained within the subterranean formation 108.

As shown in FIG. 1A, the drilling tool 100 is provided with a sampling tool 114, comprising one or more interface(s) 118 which may extend from the drilling tool 100 and establish a seal with the mudcake 110. Also, backup pistons 116 may extend from the drilling tool 100 to assist in establishing the seal by providing force to push the interface 118 against the mudcake 110. When a seal is formed, fluid from the subterranean formation 108 may flow into the drilling tool 100 via the sampling tool 114.

As described in greater detail below, the example one or more formation interface(s) 118 are configured in a way formation fluid may be sampled or produced from the formation 108. The formation interface(s) 118 may also be configured to inject a buffer or displacement fluid into the formation 108 to facilitate displacement of the formation fluid therein. As is also described in greater detail below, the example sampling tool 114 may also include a heat source (not shown) to heat a portion of the formation 108. In particular, one or more electrodes (not shown) may be provided to flow current in the formation 108 to perform ohmic heating of the formation 108 and, thus, formation fluid therein.

Figure 1B:
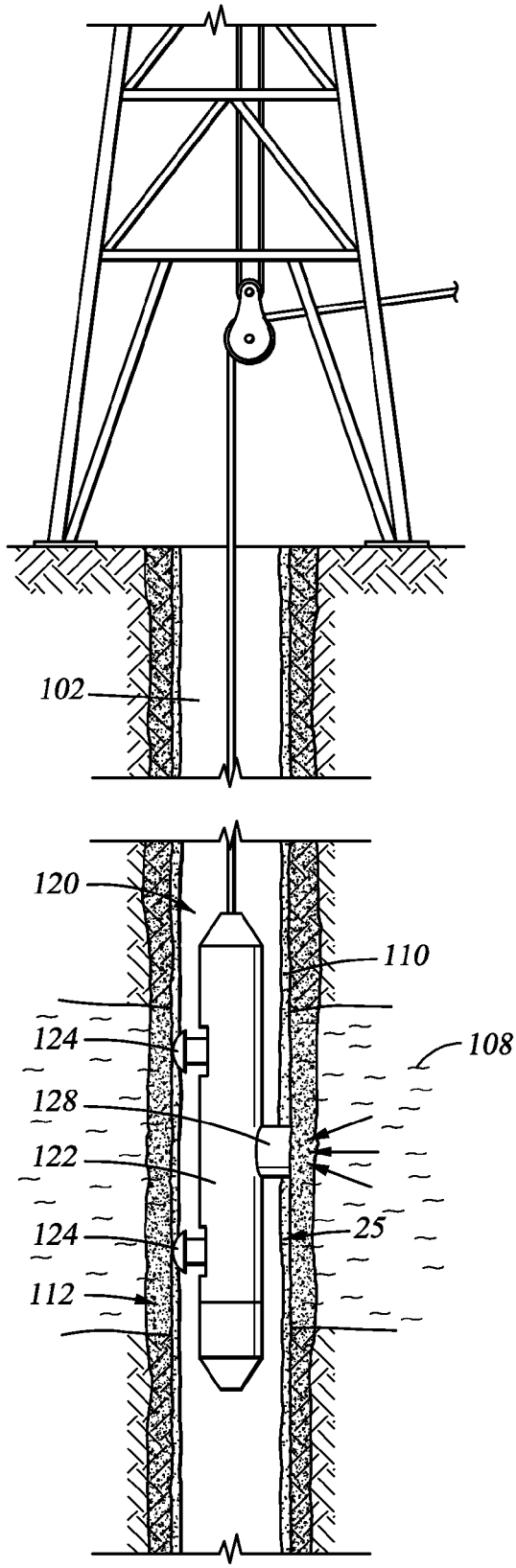
FIG. 1B depicts an example downhole wireline tool deployed from a rig into a wellbore.

FIG. 1B depicts an example downhole wireline tool 120 deployed from a rig into the wellbore 102. The wireline tool 120 may be used instead of or in addition to the drilling tool 100 of FIG. 1A to implement the example fluid sampling methods and apparatus described herein. In some cases, the wireline tool 120 may be lowered into the wellbore 102 after removal of the drillstring 104. The wireline tool 120 may include a sampling tool 122, including one or more interface (s) 128 and backup pistons 124 similar to those of the drilling tool shown in FIG. 1A. The sampling tool 122 is pushed into the mudcake 110 lining the wall of the wellbore 102 to collect a fluid sample from the subterranean formation 108 using the example methods and apparatus described in greater detail below. In addition to the conveyances shown in FIGS. 1A and 1B, other tools or conveyances such as coiled tubing, casing drilling and other variations of downhole tools may be used to implement the example formation fluid sampling methods and apparatus described herein.

Figure 2:
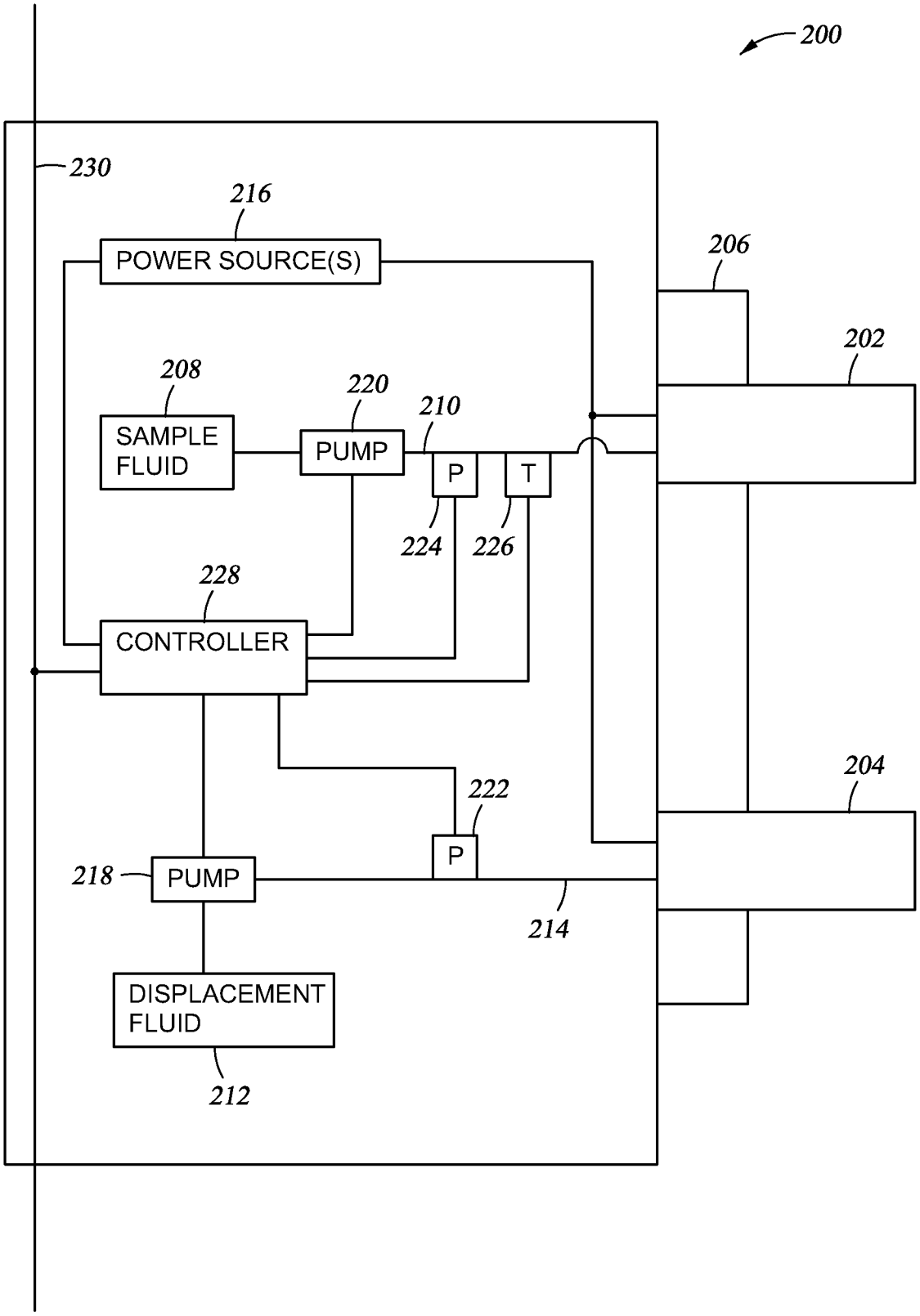
FIG. 2 is a schematic block diagram of an example sampling tool that may be used to implement the example tools of FIGS. 1A and 1B.

FIG. 2 is a schematic block diagram of an example sampling tool 200 that may be used to implement the example tools 100 and 120 of FIGS. 1A and 1B. As shown in FIG. 2, the example sampling tool 200 includes a plurality of formation interfaces 202 and 204, which are depicted as probes or barrels, but could alternatively be configured in any other desired manner to interface or fluidly couple to a subterranean formation (e.g., the formation 108 of FIGS. 1A and 1B) through mudcake lining a wellbore wall (e.g., the wellbore 102). The formation interfaces 202 and 204 are surrounded by a packer 206 (e.g. an elastomeric pad) to facilitate sealing of the tool 200 against a wellbore wall in a conventional manner.

As described in greater detail below, the formation interface 202 is configured to produce or extract formation fluid from a subterranean formation to collect a fluid sample in a sample fluid container or vessel 208 via a flowline 210. The formation interface 204 is also configured to inject a displacement fluid from a displacement fluid container or vessel 212 into the subterranean formation via a flowline 214 to facilitate mobilization of a fluid sample being collected by the tool 200. Various types of buffer or displacement fluids may be used in the example tool 200. For example, nitrogen, carbon dioxide, dibromoethane, and/or steam generated downhole from a chemical reaction, may be used in the displacement fluid container 212. Alternatively wellbore fluid may be used as a displacement fluid.

To provide a heat source to heat a portion of a subterranean formation being sampled, the example tool 200 includes one or more power sources 216 electrically coupled to the formation for example through the interfaces 202 and 204 so that the formation interfaces 202 and 204 also function as electrodes. In this manner, the power source(s) 216 may deliver alternating current or direct current power to the formation interfaces 202 and 204 which, in turn, are electrically and fluidly coupled to a portion of a subterranean formation. In particular, current may flow in the formation between the formation interfaces 202 and 204 (i.e., between the electrodes 202 and 204) to dissipate electrical energy as heat via the resistivity of the portion of the formation between the interfaces 202 and 204, thereby ohmically heating the portion of the formation between the interfaces 202 and 204. As the portion of the subterranean formation between the interfaces 202 and 204 is heated, the viscosity of any formation fluid therein may be decreased to facilitate its production or extraction via the interface 202.

The example tool 200 includes a pressurization device or pump 218 to inject displacement fluid from the container 212 into a subterranean formation via the interface 204 (e.g., a probe or barrel). The example tool 200 also includes a pumpout or pump 220 to produce or extract formation fluid from the subterranean formation and to store it in the sample fluid container 208 for subsequent analyses (e.g., uphole and/or downhole analyses), or dump it into the wellbore (not shown). To measure or detect pressures associated with the portion of the formation being sampled, the example tool 200 includes pressure sensors 222 and 224, which are coupled to the flowlines 214 and 210, respectively. The example sampling tool 200 may also include a temperature sensor 226 to measure or detect a temperature of the portion of the formation being heated and sampled. While one temperature sensor is shown as being associated with the flowline 210, the temperature sensor 226 may be located in other positions and/or multiple temperature sensors may be used.

The example tool 200 also includes a controller 228 to control the operation of the tool 200 to heat a portion of a subterranean formation, inject displacement fluid into the heated portion of the formation, and to extract a sample of heated formation fluid. In particular, the controller 228 is operatively coupled to the power source(s) 216, the pumps 218 and 220, the pressure sensors 222 and 224, and the temperature sensor 226 to control the operation thereof to perform the example fluid sampling methods described herein. The controller 228 may also be communicatively and/or operatively coupled to a surface computer (not shown) or the like via a communication link or bus 230. Thus, the controller 228 may receive commands from an operator at the surface and/or may convey raw data, analysis results, etc. to the surface computer.

While the formation interfaces 202 and 204 of the example tool 200 are depicted as being integrated electrodes and probes or barrels (i.e., a production probelbarrel and an injection probelbarrel), separate electrodes and flowlines could be used instead. Examples of such non-integrated formation interfaces are described in greater detail below in connection with FIGS. 9 and 12.

Figure 3:
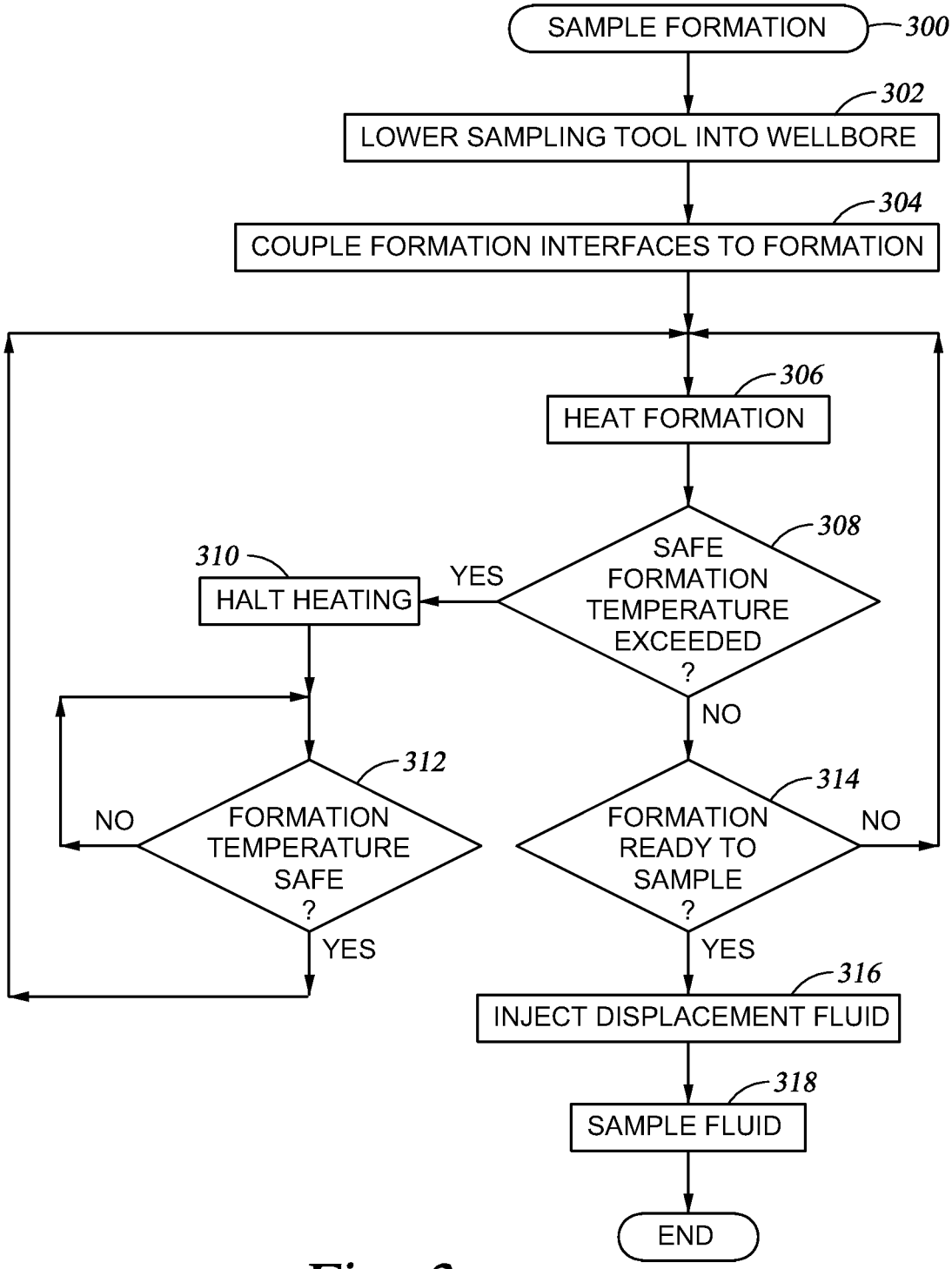
FIG. 3 depicts an example method that may be used by the example apparatus described herein to extract fluid such as, for example, heavy oil or bitumen from a subterranean formation.

FIG. 3 depicts an example method 300 that may be used by the example apparatus described herein to extract fluid (e.g., relatively viscous fluids such as heavy oil or bitumen) from a subterranean formation. The example method 300 is depicted as a plurality of blocks or operations, which may be implemented using, for example, software or a program composed of machine readable code, instructions, etc. stored on a tangible medium (e.g., a compact disc, floppy disc, a semiconductor memory, etc.) and executable by a processor or other processing unit (e.g., the controller 228 of FIG. 2). However, any combination of software and/or hardware may be used to implement the example blocks of FIG. 3. For example, dedicated purpose digital and/or analog circuitry (e.g., an application specific integrated circuit, discrete semiconductor devices, passive components, etc.) may be used to implement the operations associated with the blocks of FIG. 3. Further, the order of blocks may be changed, and one or more of the operations associated with the blocks may be performed manually, or eliminated without departing from the spirit of the described example.

Now turning in detail to the example method 300 of FIG. 3, a sampling tool (e.g., the sampling tool 200 of FIG. 2) is lowered into a wellbore (block 302). Such lowering may be performed via a wireline, a drillstring, coiled tubing, etc. When the sampling tool is positioned adjacent or proximate to a formation to be sampled, the formation interfaces (e.g., the interfaces 202 and 204) are coupled to the formation (block 304). The coupling of the formation interfaces at block 304 may include both fluid coupling of flowlines (e.g., probes or barrels) as well as electrical coupling of electrodes to the formation to be sampled. The formation interface(s) may be extended from the sampling tool, and backup pistons or the like may be used to push the formation interfaces into mudcake lining a wellbore wall and into fluid and electrical contact with the underlying formation. It should be appreciated that electrical contact is not required in conductive wellbore fluids.

The formation is then heated (block 306) by, for example, applying electrical power (e.g., alternating or direct current voltage via the power supplies 216) to the electrodes (e.g., the interfaces 202 and 204) to cause current to flow though a portion of the formation between the electrodes. Because of the resistivity of the formation, as the current flows through the formation, electrical energy is dissipated into heat, which is further conducted or diffused through the formation. Alternatively, the formation may be heated using dielectric heating.

The temperature of the formation may be monitored (e.g., by the controller 228 and the temperature sensor 226) and compared to a predetermined threshold to determine if a safe formation temperature has been exceeded (block 308). The threshold temperature may be selected to ensure that the formation temperature does not exceed a temperature at which formation fluid may be decomposed or otherwise damaged. If the safe formation temperature is exceeded at block 308, formation heating may be halted or ceased (block 310). For example, in the example tool 200 of FIG. 2, the controller 228 may cause the power supplies 216 to remove electrical power from the electrodes (i.e., the formation interfaces 202 and 204). Once heating has been halted, the formation temperature is monitored to determine when the temperature has returned to a safe level (block 312). When the formation temperature has reached a safe level, the example method 300 returns to block 306 to continue or resume heating of the formation if desired.

The measured temperature may be used to determine a viscosity of the formation fluid to be sampled. At a pressure, the temperature dependence of viscosity $\eta_0$ may be described by the empirical rule of Vogel in Equation 1 below:

$$\eta_0/\text{mPa}\cdot\text{s}=\exp[e+f/\{g+(T/K)\}] \quad (1)$$

where the parameters e, f and g may be determined by adjustment to measured values.

More generally, the viscosity $\eta(T, p)$ of the formation fluid can be represented by the empirical Vogel-Fulcher-Tammann (VFT) Equation 2 below:

$$\eta(T, p)/mPa\cdot s = \exp\left\{a + b(p/MPa) + \frac{c + d(p/MPa) + e(p/MPa)^2}{(T/K) - T_0}\right\}, \quad (2)$$

where the 6 parameters a, b, c, d, e and $T_0$ may be obtained by regression to measured viscosities.

During the heating process, the formation temperature may exhibit gradients such that the formation temperature and, thus, the temperature of the formation fluid therein is initially highest nearer to the formation interfaces or electrodes and decreases as distance from the electrodes increases. Thus, during the heating process, multiple heated volumes of the formation are initially separated by lower temperature volumes and, thus, do not overlap. However, as the heating process progresses, these initially separate heated volumes or regions may merge or overlap to form a region in which formation fluid viscosity is relatively lower than surrounding non-overlapping volumes or regions.

During the heating process, the example method 300 determines whether the formation is ready to sample (block 314). The determination at block 314 may be performed by monitoring pressure (e.g., a differential pressure, a pressure at one of the interfaces, a pressure pulse propagation between interfaces, etc.) at the formation interfaces and detecting a merging of heated volumes of the formation being sampled. In the example implementation of FIG. 2, the controller 228 may use the pressure sensors 222 and 224 to detect a pressure change at the formation interfaces 202 and 204 indicative of a merging of heated regions or volumes of the formation being sampled. Some known techniques that may be useful to implement the operation(s) of block 314 may be based on, for example, the techniques described in U.S. Pat. No. 4,742,459, which is hereby incorporated by reference in its entirety. If the formation is not ready for sampling at block 314, control returns to block 306 to continue the heating process.

If the formation is ready to be sampled at block 314, displacement or buffer fluid may be injected into the heated portion of the formation to facilitate mobilization of the heated formation fluid (block 316). In the example of FIG. 2, the controller 228 may operate the pump 218 to inject displacement fluid from the displacement fluid container 212 via the flowline 214 and the interface or probe 204 into the heated portion of the formation. Injecting pressurized displacement fluid in this manner further reduces the drawdown pressure needed to extract fluid from the formation and, as a result, reduces or eliminates the possibility of changing the state of the fluid sample (i.e., forming a gaseous phase), and/or damaging the formation, etc.

As the displacement fluid pressurizes the heated formation fluid, the example method 300 samples the formation fluid (block 318). In the example of FIG. 2, the controller 228 may operate the pump 220 to draw, extract, or produce heated formation fluid via the interface 202 and the flowline 210 and to store the extracted formation fluid in the sample fluid container 208. The fluid sampling operation at block 318 is preferably completed prior to any displacement fluid reaching the formation interface 202. Once the fluid sampling operation at block 318 is complete, the example method 300 ends.

Figure 4:
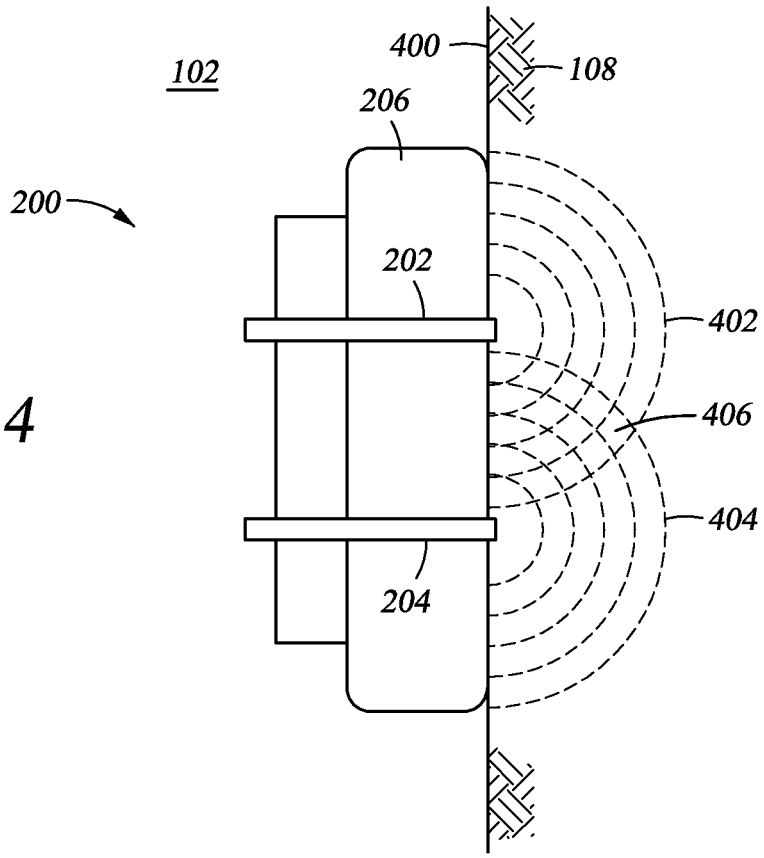
FIG. 4 is a partial side view of the example sampling tool of FIG. 2 coupled to a portion of the wall of the wellbore of FIGS. 1A and 1B.

FIG. 4 is a partial side view of the example sampling tool 200 of FIG. 2 coupled to a portion 400 of the wall of the wellbore 102 (FIG. 1A). As shown, the formation interfaces 202 and 204 function as electrodes, which are electrically coupled to the subterranean formation 108. The electrodes 202 and 204 are coupled to the power source(s) 216 (FIG. 2) to cause the electrodes 202 and 204 to emit overlapping electric fields 402 and 404 that penetrate the subterranean formation 108 and flow electrical currents therethrough. The generated currents flow primarily in a region 406 in which the electric fields 402 and 404 overlap and, as a result, a portion of the formation 108 corresponding to the region 406 is ohmically heated. Further, the viscosity of any formation fluid in the region 406 will be reduced as the temperature of the region 406 increases.

Additionally, the example sampling tool 200 includes the packer 206, which may be coupled to the mudcake (not shown) around the sampling tool 200 to form a seal. The seal formed by the packer 206 may prevent additional drilling mud from penetrating the subterranean formation 108 near the interfaces 202 and 204. If additional drilling mud were allowed to penetrate the subterranean formation 108 near the interfaces 202 and 204, more virgin fluid may become contaminated, causing a larger invaded zone 112 and reducing the likelihood of obtaining a representative sample of fluid.

Figure 5:
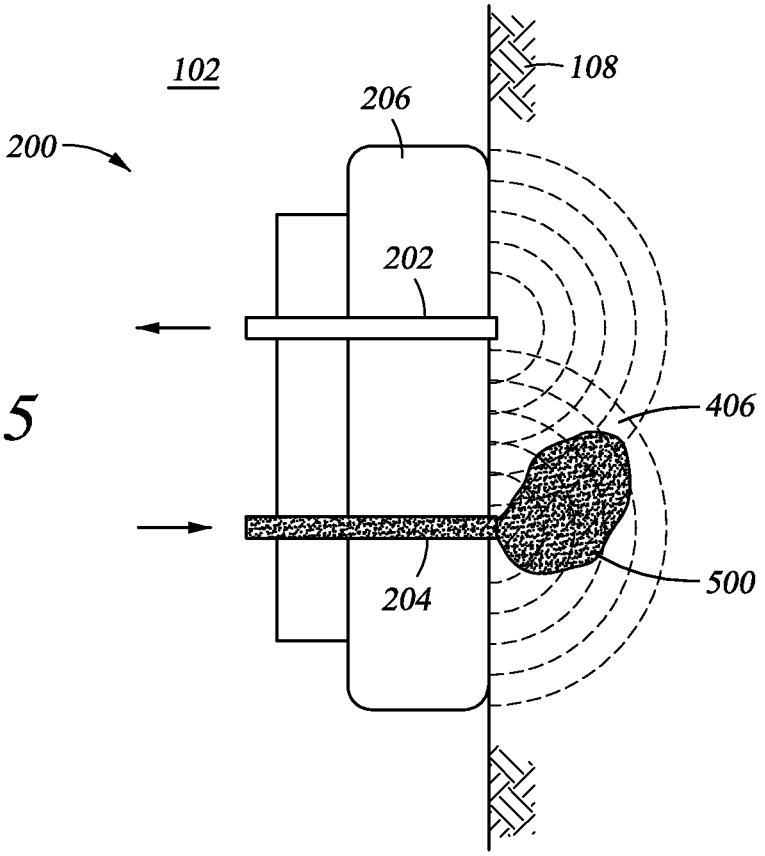
FIG. 5 is another partial side view of the example sampling tool of FIG. 2 injecting a portion of displacement fluid from a displacement fluid container into a heated portion of a subterranean formation via a formation interface.

FIG. 5 is another partial side view of the example sampling tool 200 injecting a portion of displacement fluid 500 from the displacement fluid container 212 (FIG. 2) into the heated portion 406 of the subterranean formation 108 via the formation interface 204. The portion of displacement fluid 500 pressurizes the portion 406 of the formation 108 and, thus, urges any formation fluid in the region 406 toward the production formation interface 202. This reduces the drawdown pressure needed at the interface 202 to extract heated formation fluid from the region 406 of the formation 108. As described in connection with FIG. 3 above, when injecting the displacement fluid 500 to mobilize the heated formation fluid, the collection of formation fluid at the formation interface 202 may be halted before the displacement fluid 500 enters the formation interface 202 to prevent contamination of the formation fluid sample.

Figure 6:
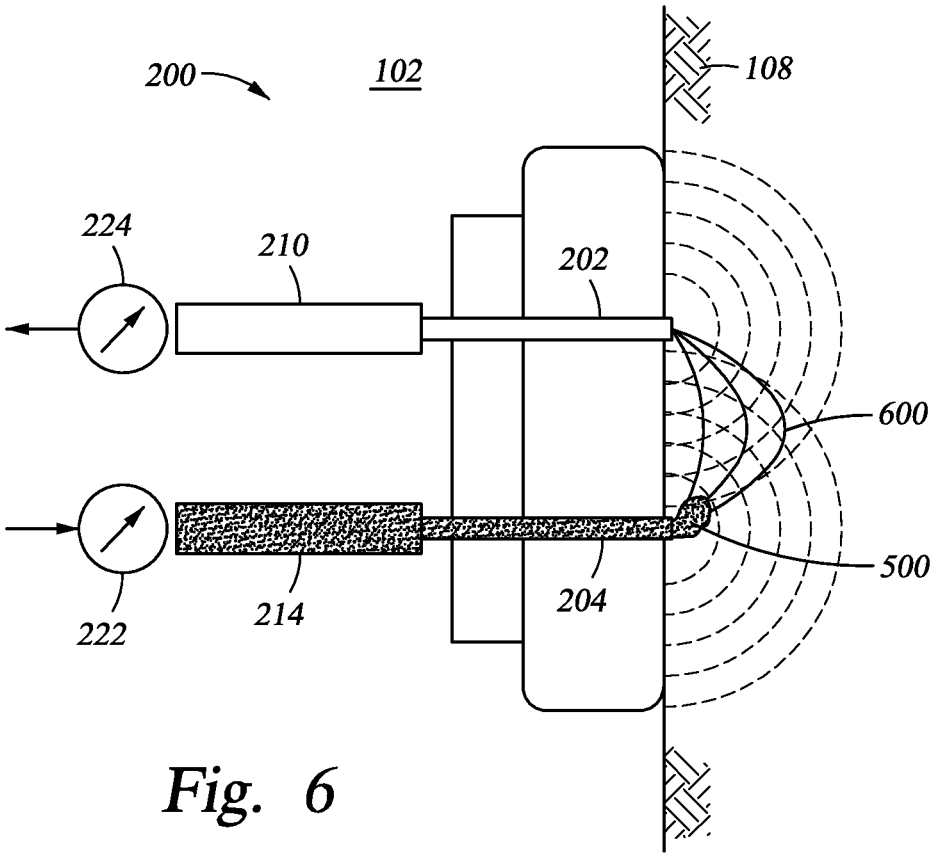
FIG. 6 is another partial side view of the example sampling tool of FIG. 2 coupled to a wall of the wellbore of FIGS. 1A and 1B.

FIG. 6 is another partial side view of the example sampling tool 200 coupled to a wall of the wellbore 102. In the illustrated example, the flowlines 210 and 214 are shown as being fluidly coupled to the formation interfaces 202 and 204, respectively, to propagate fluid to and from the sampling tool 200 and the subterranean formation 108. Additionally, the pressure sensors 222 and 224 are coupled to the flowlines 214 and 210, respectively, and may be used to determine when two or more heated portions or volumes of the subterranean formation 108 merge or meet by detecting pressure increases or decreases in the flowlines 210 and 214 as the displacement fluid is injected or the formation fluid is sampled. As noted above, the formation interfaces 202 and 204 also function as electrodes to generate current lines 600, which represent electric currents ohmically heating the subterranean formation 108.

As noted above in connection with FIG. 3, portions or volumes of the subterranean formation 108 may begin to heat first, with the fastest heating typically taking place near the formation interfaces 202 and 204. When these heated volumes of the subterranean formation 108 reach a certain threshold temperature, the viscosity of the fluid within these volumes is reduced sufficiently for the fluid to be considered mobile. As a result, there may be two separate mobile portions or volumes of the subterranean formation 108 at a time shortly after heating begins. As time passes, the mobile portions of the subterranean formation 108 may expand, generally along the current lines 600, as more fluid within the subterranean formation 108 reaches the threshold temperature and becomes mobile. Over time, heat will be conducted or diffused outward from the current lines 600 at a rate determined by the thermal conduction properties of the subterranean formation 108. Eventually, the two individual mobile portions or volumes of the subterranean formation 108 may merge as the fluid near the current lines 600 becomes mobile.

During the period that there are two individual mobile portions or volumes of the subterranean formation 108, the pressure sensors 222 and 224 may determine (e.g., via the controller 228 of FIG. 2) that the fluid within the subterranean formation 108 is not sufficiently mobile. However, when two or more individual mobile portions merge, the pressure sensors 222 and 224 may determine there is sufficient mobilization. For example, the displacement fluid 500 may exert a known pressure on the subterranean formation 108 at the formation interface 204 while the individual mobile portions of fluid have not yet merged. The pressure sensor 222 monitors this pressure and may detect a decrease in pressure when the individual mobile portions of fluid merge. When the pressure sensor 222 detects the decrease in pressure, the formation interface 204 may inject the displacement fluid 500 into the subterranean formation 108 to encourage the production of a fluid sample in the production interface 202.

In an example calculation illustrating power dissipation in the formation, an alternating current I is emitted from a spherical electrode of volume V in a homogeneous medium of electrical conductivity σ. The power dissipated dP in a elemental volume dr·dS at a radius r from the electrode is given by Equation 3:

$$dP = \frac{I^2}{16\pi^2\sigma}\frac{dSdr}{r^4} \tag{3}$$

For I=1 A, $\sigma=0.01\ S\cdot m^{-1}$ and r=1 m, $dP=0.6\ W\cdot m^{-3}$, while for r=0.1 m, $dP=600\ W\cdot m^{3}$ and this is sufficient to heat the formation and permit sampling of the formation fluid. This example helps illustrate the tendency for the volumes of subterranean formation nearest the electrodes to heat faster.

It should be noted that, in the example of FIG. 6, the shapes or arcs of the current lines 600 may be dependent on a frequency of the power source(s) coupled to the electrodes (i.e., the formation interfaces 202 and 204). For instance, the current lines 600 may have an arcuate shape that extends farther from the electrodes at a frequency of 500 Hz than the arcuate shape of the current lines 600 at a frequency of 1,000 Hz. The shapes of the current lines 600 may also be determined by small variations in the resistivity or impedance of the subterranean formation 108. However, electrical currents will follow the path of least resistance, so the paths of the current lines 600 may vary through the subterranean formation 108 in manners that are difficult to predict and, thus, the example current lines 600 are merely illustrations of general electrical behavior.

Figure 7:
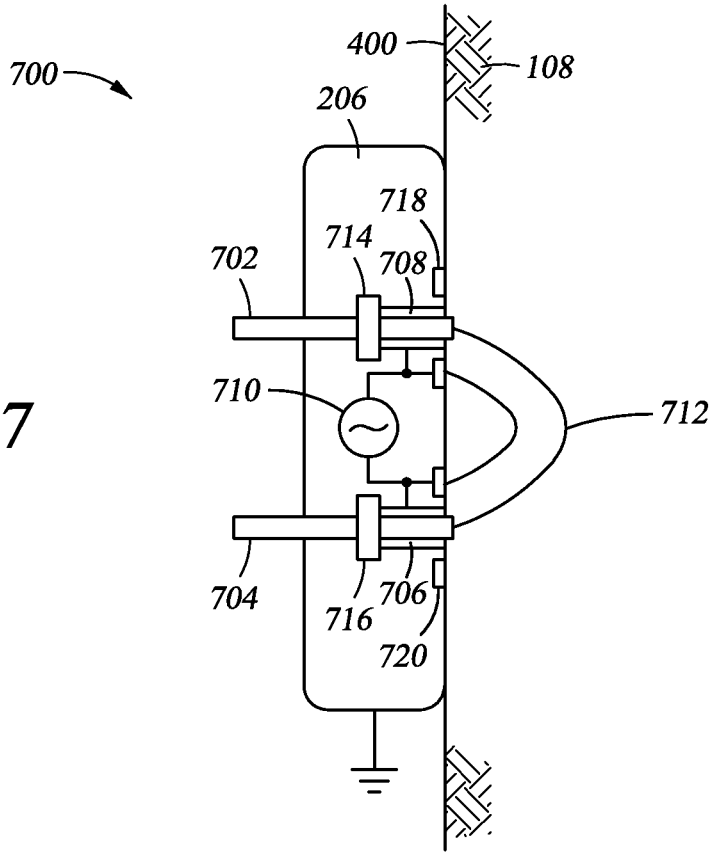
FIGS. 7 and 8 are schematic block diagrams of example sampling tool electrical configurations that may be used to implement the example sampling tool of FIG. 2.

FIG. 7 is a schematic block diagram of an example sampling tool electrical configuration 700 that may be used to implement the example sampling tool 200 of FIG. 2. The example configuration 700 of FIG. 7 includes flow lines 702 and 704 that are fluidly coupled with probe barrels 706 and 708. In particular, probe barrels 706 and 708, which also form electrodes to be electrically coupled to the formation 108, are electrically coupled to an alternating current power source 710 so that one of the probe barrels 706 and 708 is coupled to one terminal of the power source 710 and the other one of the ends 706 and 708 is coupled to the other terminal of the power source 710. The barrels 706 and 708, which flow currents along current lines 712 in the formation 108, are electrically insulated from the remainder of the formation interface, the flowlines 702 and 704, etc. via insulating layers 714 and 716. Encircling the barrels 706 and 708 are additional electrodes 718 and 720, which may serve as guard electrodes or passive focusing electrodes. Such focusing electrodes may be used to direct the current 712 along a desired path through the subterranean formation 108.

Figure 8:
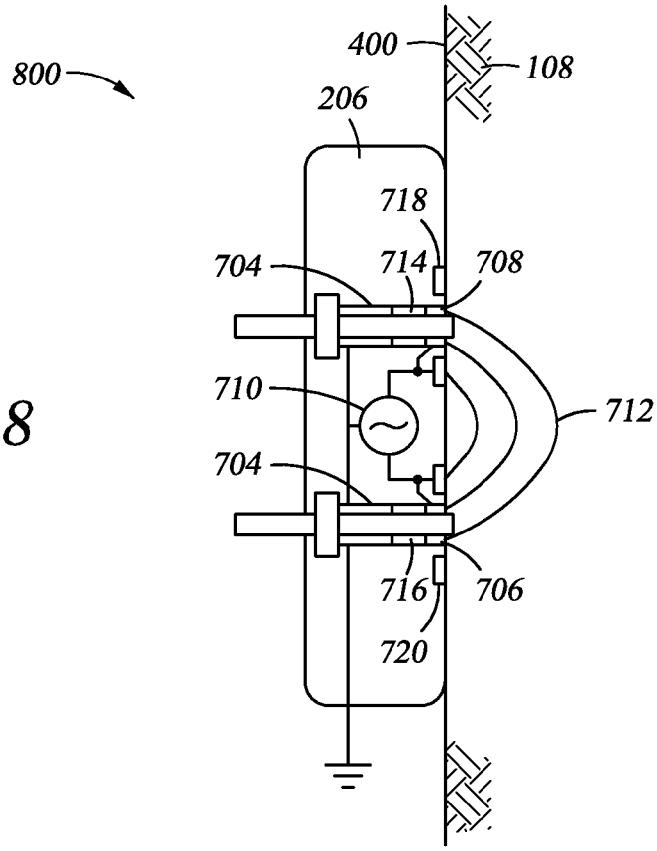

FIG. 8 is a schematic block diagram of a configuration 800 similar to the configuration 700 of FIG. 7. As shown in the example configuration 800, the insulating layers 714 and 716 are implemented as insulating cylindrical sections or rings that form portions of the probe barrels. While electrodes 718 and 720 are shown to be implemented as passive focusing electrodes in the shown example, these electrodes may be implemented as active focusing electrodes.

Figure 9:
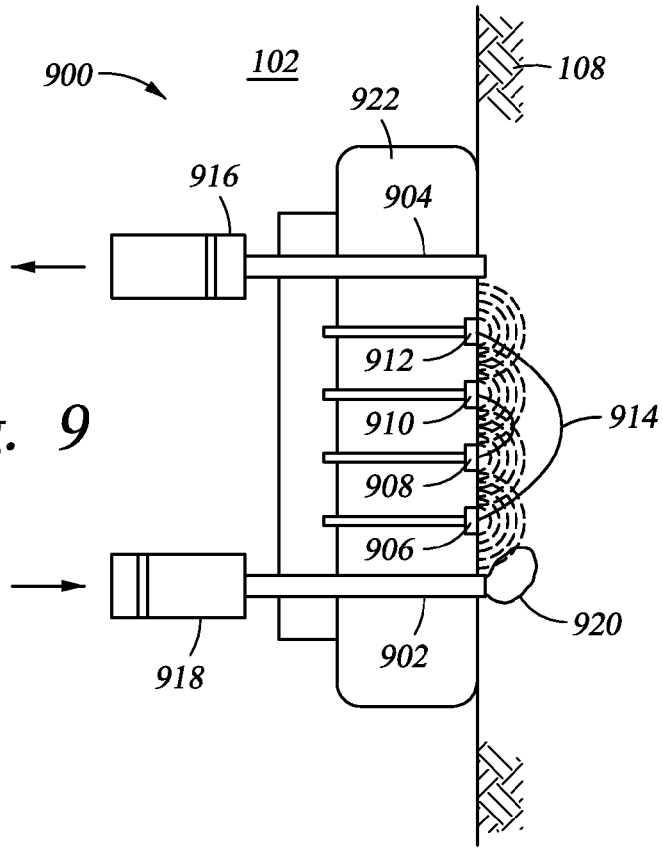
FIG. 9 is a side view of an example formation interface that may be used to implement the example sampling apparatus described herein.

FIG. 9 is a side view of an example formation interface 900 that may be used to implement the example sampling apparatus described herein. In contrast to the example formation interfaces 202 and 204 described above, the example formation interface 900 includes a displacement fluid injection probe 902, a sampling probe 904, and a plurality of electrodes 906, 908, 910, and 912 that are non-integral or separate from the probes 902 and 904. The electrodes 906-912 are arranged between the injection probe 902 and the sampling probe 904 to heat a reduced volume of the formation 108, which reduces sampling times and thereby the risk of the sampling tool (e.g., the sampling tool 200) from becoming stuck in the wellbore 102 because of a too long station time. One or more electrical power sources (not shown) may be coupled to the electrodes 906-912 to flow current in the formation along, for example, lines or paths 914.

The example configuration 900 of FIG. 9 also includes a production piston 916 coupled to the production barrel or interface 904 and an injection piston 918 coupled to the injection barrel or interface 902. The pistons 916 and 918 may be used instead of the pumps 220 and 218 and containers 208 and 212 of FIG. 2 to reduce the parasitic volume of sampling fluid associated with a sampling tool. Such a reduction of the parasitic volume of sampling fluid enables a relative reduction in the amount of formation to be heated and, thus, time needed to collect a given fluid sample volume.

In operation, with the example configuration 900 of FIG. 9, as the electrodes 906-912 heat the subterranean formation 108, the injection piston 918 may apply a pressure to a displacement fluid 920, which applies pressure to the fluid within the subterranean formation 108. A pressure sensor such as, for example, the pressure sensor 222 as described in FIG. 2 may monitor the pressure applied by the displacement fluid 920 on the fluid in the subterranean formation 108. As the fluid within the heated portions of the subterranean formation 108 becomes increasingly mobile, the pressure on the displacement fluid 920 decreases. The drop in pressure may be compensated by increasing or decreasing the amount of force applied to displacement fluid 920 by the injection piston 918. The pressure from the displacement fluid 920 causes a sample of the mobile fluid in the heated portion of the subterranean formation 108 to flow into the production barrel 904 and into the production piston 916. The production piston 916 may assist the flow of the fluid sample into the production piston 916 by drawing in the fluid sample using suction. The production piston 916 may also be replaced by a production container to passively collect the fluid sample pushed by the displacement fluid 920.

Extending on both sides of the formation interfaces 902 and 904 there is a packer 922, which is deployed against the wellbore wall in the circumferential direction. As the injection piston 918 exerts pressure on the displacement fluid 920, the displacement fluid 920 is pushed into the subterranean formation 108 and exerts pressure in every direction. Hydraulic shorting may occur between the formation interface 902 and the wellbore 102 if the pressure causes the wellbore wall to yield before the heated formation fluid is mobilized. The packer 922 supports the wellbore wall and prevents hydraulic shorting between the wellbore 102 and the formation interface 902.

FIGS. 10A-D illustrate schematic block diagrams of example electrical power source connections or configurations that may be used for a plurality of electrodes deployed in a sampling tool. The electrical power sources described in connection with FIGS. 10A-D below may be any combination of alternating current (AC) and/or direct current (DC) voltage and/or current supplies. Additionally, the electrical power sources described in these examples may have equal or unequal voltages, currents, phase shifts, and/or frequencies. The choice of AC, DC, voltages, currents, phase shifts, and/or frequencies may be based on, for example, resistivity or impedance measurements of formations to be sampled.

Figure 10A:
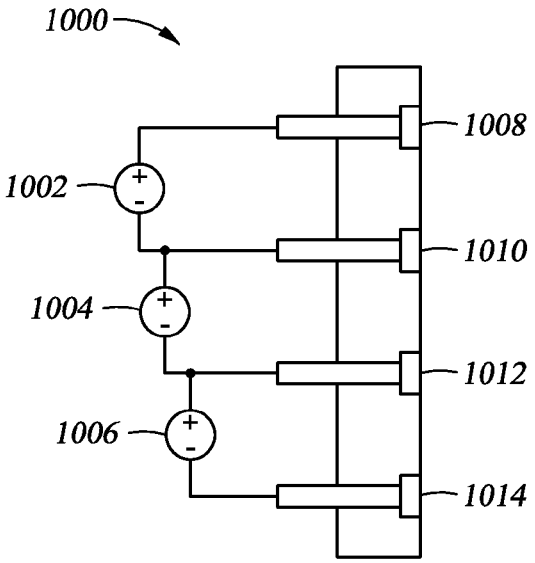
FIGS. 10A-D depict example schematic block diagrams of power source and electrode arrangements that may be used to implement the example methods and apparatus described herein.

FIG. 10A illustrates an example configuration 1000 in which electrical power sources 1002, 1004, and 1006 are coupled to electrodes 1008, 1010, 1012, and 1014 in a serial or stacked manner as shown. Each of the power sources 1002-1006 is coupled to a respective pair of the electrodes 1008-1014 so that energy applied across each pair of the electrodes 1008-1014 can be individually or independently configured or controlled. Such individual configurability may be particularly useful to individually, dynamically adjust the energy delivered to the portions of the formation being heated by corresponding pairs of the electrodes 1008-1014 to facilitate even heating of a formation (e.g., the formation 108). For instance, if one portion of a subterranean formation is heating more slowly than the other portions (e.g., due to higher resistivity, higher thermal conductivity, etc.), the voltage or energy delivered to the electrodes near to or corresponding to that portion may be increased to heat the portion faster.

Figure 10B:
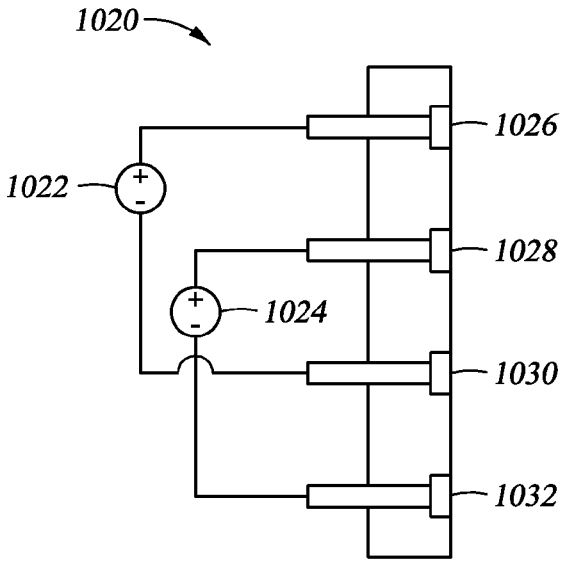

FIG. 10B illustrates another example configuration 1020 in which electrical power sources 1022 and 1024 are coupled to respective pairs of electrodes 1026, 1030 and 1028, 1032 to form overlapping current flows through a formation being heated. In other words, currents flowing between the electrodes 1026 and 1030 overlap with current flowing between the electrodes 1028 and 1030. This may cause the portion of the subterranean formation corresponding to the region of overlap to heat more quickly than other portions in which there is substantially no current flow overlap.

Figure 10C:
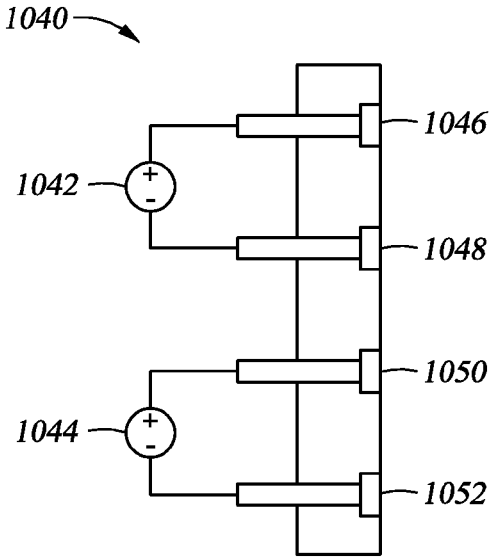

FIG. 10C illustrates another example configuration 1040 in which electrical power sources 1042 and 1044 are separately coupled to respective pairs of electrodes 1046, 1048 and 1050, 1052 to form non-overlapping currents in a formation being heated. The configuration 1040 of FIG. 10C may be particularly useful where electrical isolation between the power sources 1042 and 1044 and substantially no current overlap between heated regions is desired. In the configuration 1040, because little to no current will flow between the electrodes 1048 and 1050, the portion of the formation between these electrodes will heat relatively slowly compared to the regions between the electrodes 1046 and 1048 and between the electrodes 1050 and 1052.

Figure 10D:
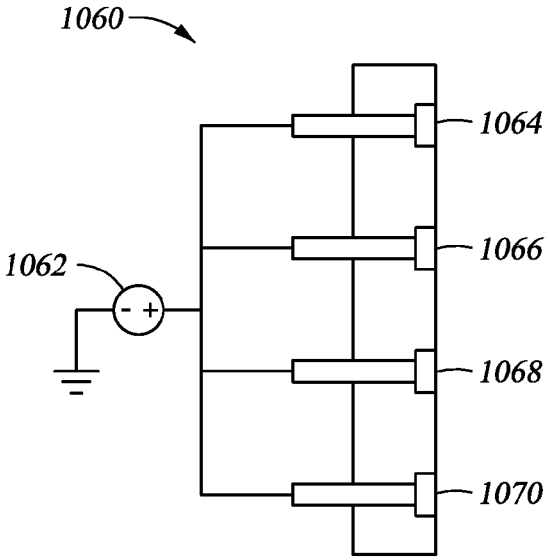

FIG. 10D illustrates another example configuration 1060 in which a single electrical power source 1062 is coupled in parallel to a plurality of source electrodes 1064, 1066, 1068, and 1070. Currents may flow from the source electrodes 1064-1070 to a return electrode (not shown), which may not be located between any formation interface probes or barrels. For example, the return electrode may be electrically coupled to the wellbore wall opposite the source electrodes 1064-1070, causing the current to flow circumferentially around the wellbore. In a subterranean formation having nearly uniform resistivity, the illustrated example of FIG. 10D may provide relatively even or uniform heating around the wellbore and allow fluid samples to be collected from a plurality of locations in the wellbore.

Although FIGS. 10A-D show example power source and electrode arrangements, it should be noted that these arrangements are not intended to be limiting. The examples shown are merely illustrative, and a particular implementation of power source configurations may use any combination of the example arrangements or other arrangements. For example, an implementation may use more or fewer electrodes and/or power sources configured to effectively heat a portion of the subterranean formation based on resistivity, permeability, and/or other relevant measurements.

The electrodes described in the foregoing examples may be arranged in any number of ways. FIGS. 11A-D illustrate four example geometries or layouts, each of which uses four electrodes. To mobilize a sample of fluid within a subterranean formation as quickly as possible, a choice of electrode layout may depend on the positioning of the production interface and the injection interface. Each of the electrodes in FIGS. 11A-D may be at a different potential, or two or more electrodes may be at the same potential. FIGS. 11A-D are example geometries or configurations for a plurality of electrodes deployed on a sampling probe. While these example geometries and configurations are illustrated, it should be noted that any other geometry or configuration that may be useful for flowing a current in a subterranean formation may be used. Also any electrode geometry and configuration may be adapted for any number of electrodes applied to the subterranean formation.

Figure 11A:
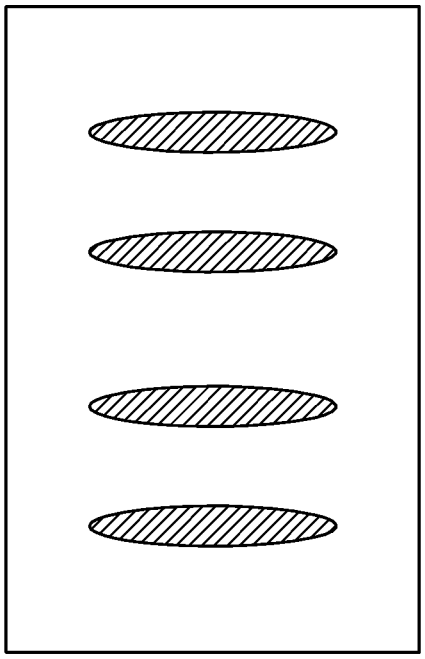
FIGS. 11A-D illustrate four example electrode geometries or layouts that may be used to implement the example methods and apparatus described herein.

FIG. 11A illustrates an example electrode configuration having four elliptical electrodes spaced apart. This configuration may be useful for any of the power source connections described in connection with FIGS. 10A-D. For example, the voltages between any pair of electrodes may be individually configured to concentrate current (i.e., heat) on a particular portion or volume of the subterranean formation. Although FIG. 11A illustrates elliptically-shaped electrodes, the electrodes may instead be configured in any combination of geometric shapes.

Figure 11B:
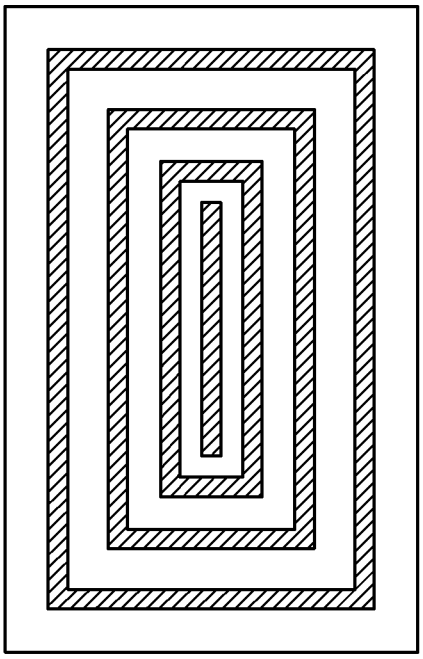

FIG. 11B illustrates an example electrode configuration having four concentric polygonal electrodes. This configuration may be useful for concentrating current (i.e., heat) radially from the center of the electrode configuration. Although FIG. 11B illustrates rectangularly-shaped electrodes, the electrodes may be configured in any combination of geometric shapes. Additionally, the some of the electrodes in the configuration of FIG. 11B may be implemented as guard electrodes or focusing electrodes to better control the penetration of current into a formation.

Figure 11C:
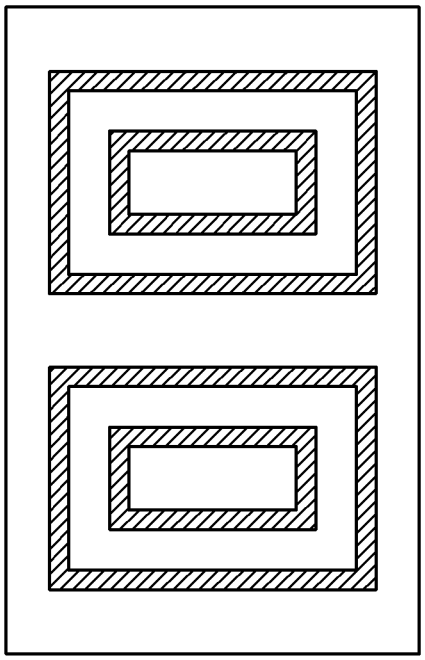
Figure 11D:
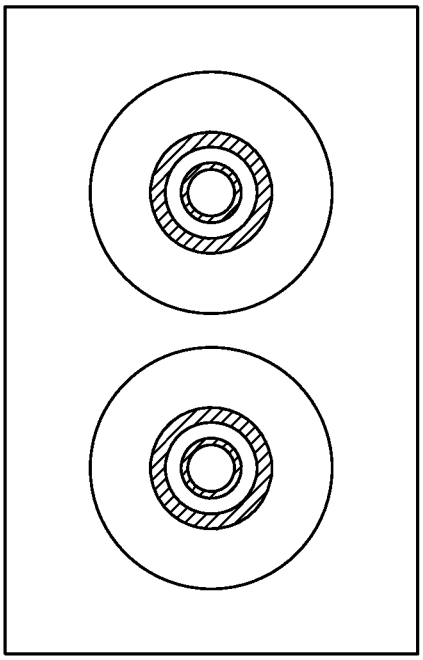

FIGS. 11C and 11D illustrate example electrode configurations having two sets of concentric electrodes. FIG. 11C is shown having concentric rectangular electrodes and FIG. 11D is shown having concentric circular or ring-shaped electrodes. The illustrated configurations may be useful for integrating the electrodes into the probe barrels as shown in FIGS. 2, 4, 6, 6, 7, and 8. The electrodes of FIGS. 11C and 11D may be implemented using guard electrodes or focusing electrodes to better control the penetration of current into a formation being heated. Although FIGS. 11C-D illustrate electrodes having generally rectangular and circular geometries, respectively, the electrodes may be configured in any combination of geometric shapes to achieve a desired heating effect.

Figure 12:
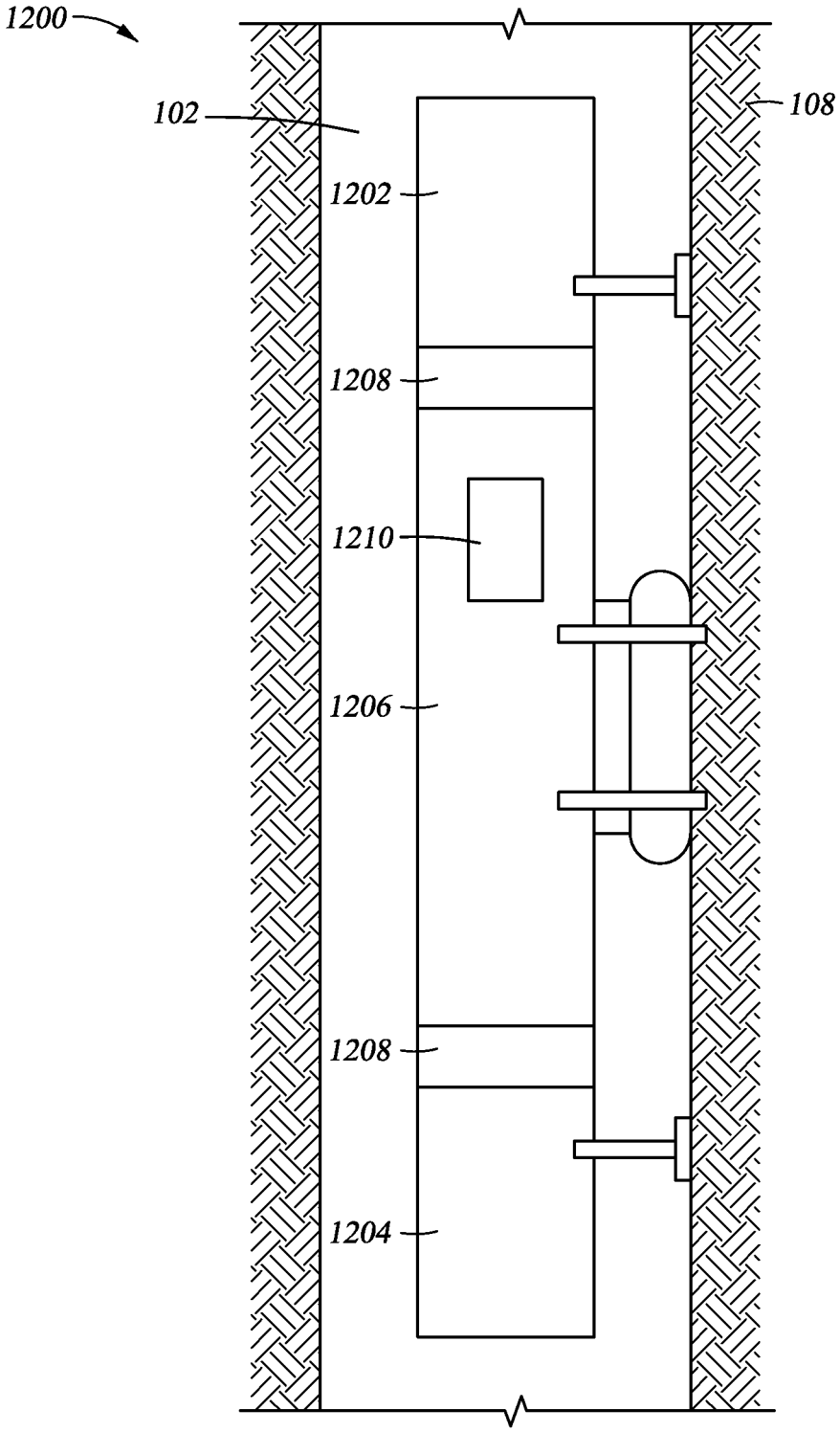
FIG. 12 is a side view of another example sampling tool deployed in the wellbore of FIGS. 1A and 1B.

FIG. 12 is a side view of another example sampling tool 1200 deployed in the wellbore 102. The sampling tool 1200 may be deployed by drillpipe, wireline, coiled tubing or any other means of deployment known or developed (not shown). The example sampling tool 1200 has electrode modules 1202 and 1204, which may be used to heat the subterranean formation 108 by generating or flowing electric current through the formation 108. More specifically, the electrode module 1202 is located uphole relative to a sampling probe module 1206 and the other electrode module 1204 is located downhole relative to the sampling probe module 1206. Each of the electrode modules 1202 and 1204 is electrically isolated from the sampling probe module 1206 by an insulation element 1208. By isolating the sampling probe module 1206 from the electrode modules 1202 and 1204, current is forced through the subterranean formation 108 instead of short-circuiting through the sampling probe module 1206. By the inclusion of vertical isolation (not shown) on the electrodes, the current may be permitted to preferentially flow over any desired azimuthal angle through the subterranean formation 108. In another example configuration (not shown), the current flows azimuthally over $2\pi$.

The heating provided by the electrode modules 1202 and 1204 heats a relatively large volume of the formation 108 as compared to the example apparatus described above. When a portion of the subterranean formation 108 is sufficiently heated, the sampling probe module 1206 may extract formation fluid using techniques illustrated in the examples described above. In addition to or as an alternative to using pressure measurements to determine when the formation 108 is sufficiently heated to be sampled, the example sampling tool 1206 may include a nuclear magnetic resonance (NMR) unit 1210 to detect the viscosity of formation fluid within heated portions of the formation 108. In this manner, when the detected viscosity is sufficiently low, the sampling module may inject displacement fluid and extract a sample of heated formation fluid as described above in connection with the other examples.

Figure 13:
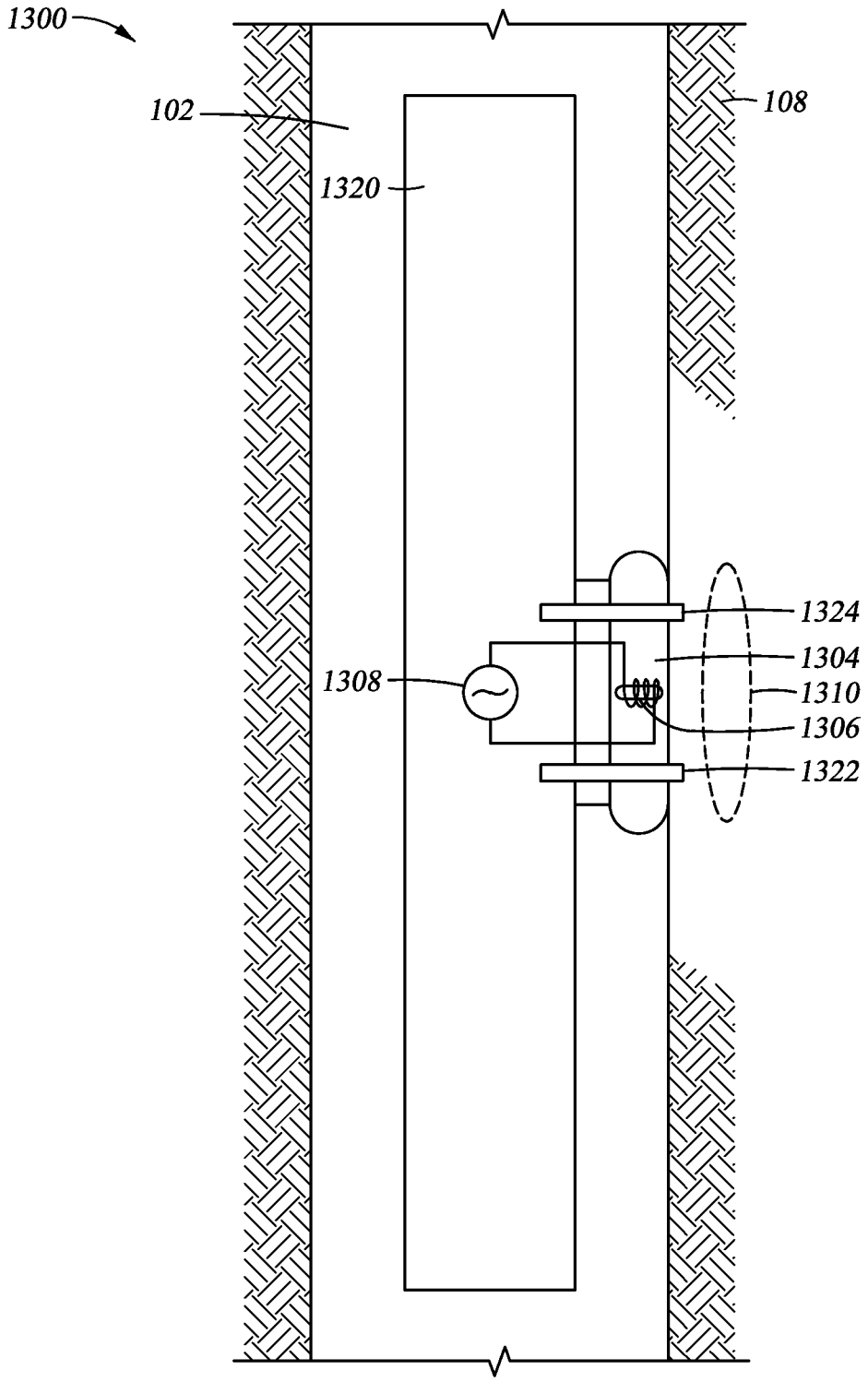
FIG. 13 is a side view of another example sampling tool comprising an induction coil to heat the formation.

FIG. 13 is a side view of another example sampling tool 1300 deployed in the wellbore 102. The sampling tool 1300 may be deployed by drillpipe, wireline, coiled tubing or any other means of deployment known or developed (not shown). The example sampling tool 1300 conveys at least one induction coil 1304, which may be used to heat the subterranean formation 108 by flowing or inducing an electric current 1310 through the formation 108. More specifically, the induction coil 1304 is located between an injection probe 1324 and a sampling probe 1322 of the sampling module 1320, and preferably, but not necessarily, near to the wellbore wall. Optionally, a ferromagnetic core 1306 is disposed in the induction coil 1304 for intensifying the magnetic field generated by the coil. In another example configuration (not shown), a plurality of coils is disposed on the sampling module 1320, for example between the injection probe 1324 and sampling probes 1322.

The heating provided by the induction coil 1304 may be well adapted for the case where the wellbore fluid is not very conductive (e.g. fresh mud, Oil Based Mud). When a portion of the subterranean formation 108 is sufficiently heated, the sampling probe module 1320 may extract formation fluid using techniques illustrated in the examples described above.

Figure 14A:
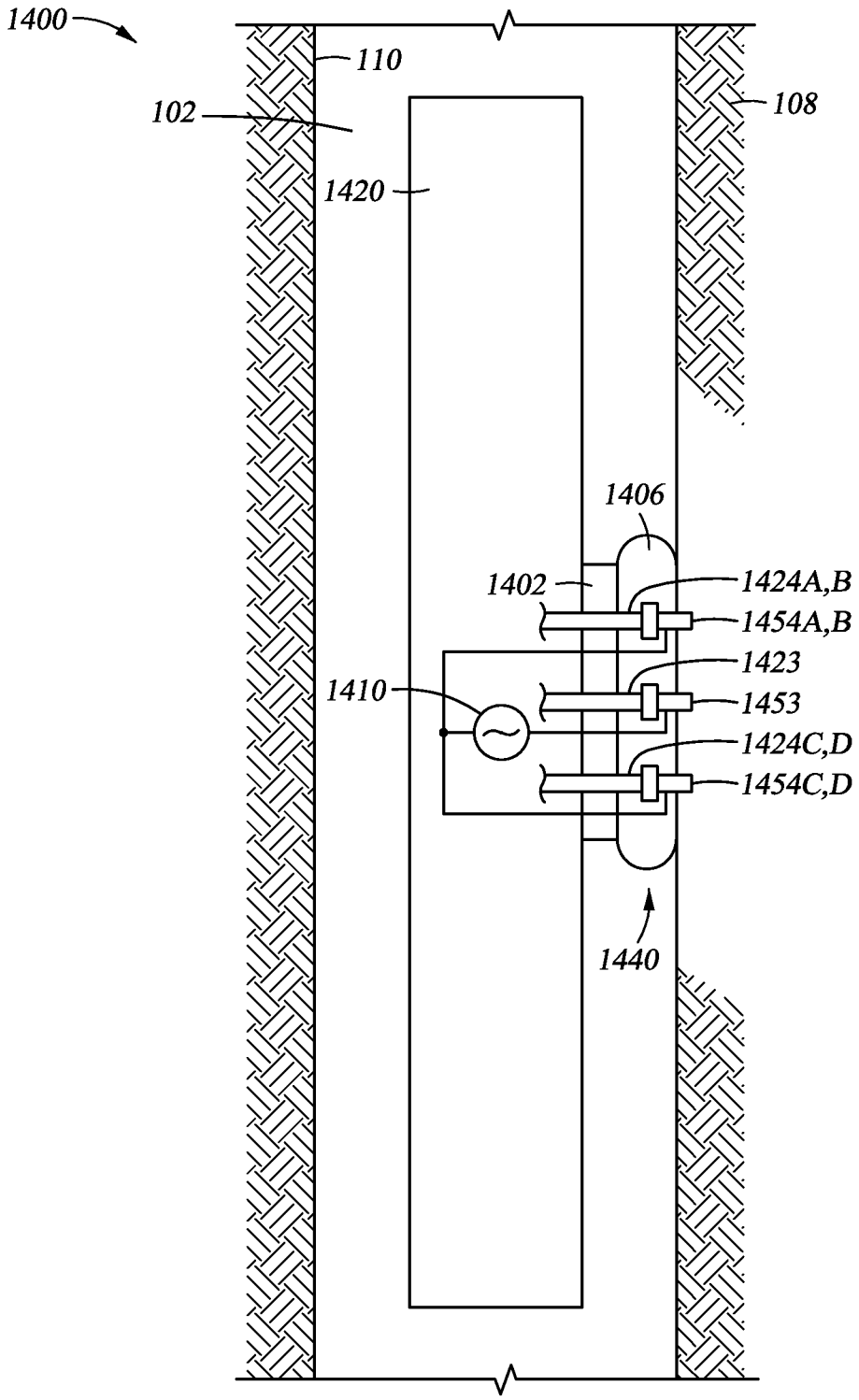
FIG. 14A is a side view of another example sampling tool comprising microwave antennas to heat the formation.

FIG. 14A is a side view of another example sampling tool 1400 comprising microwave antennas to heat the formation. The sampling tool 1400 may be deployed by drillpipe, wireline, coiled tubing or any other means of deployment known or developed (not shown). The example sampling tool 1400 includes a sampling module 1440, a frontal view thereof being detailed in FIG. 14B. The sampling module 1440 comprises an extension mechanism 1402 having a retracted position (not shown) and an extended position. In the extended position, the extension mechanism 1402 is configured to apply a packer 1406 against a wall of the wellbore 102 penetrating the formation 108 for sealing off a portion of the wall of the wellbore. When in the extended position, the extension mechanism is further configured to establish a fluid communication between the flowlines 1424A-D, 1423 and the formation 108.

Figure 14B:
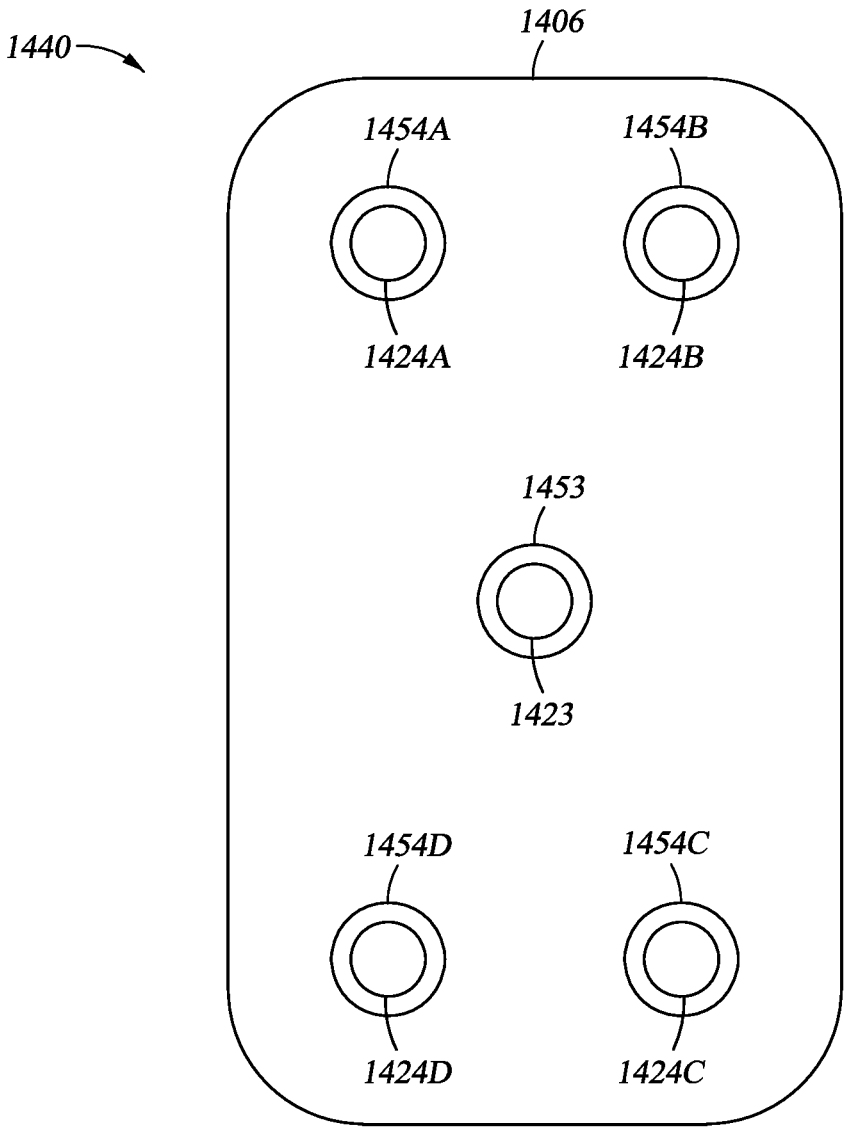
FIG. 14B is a partial front view of the example sampling tool of FIG. 14A.

As shown in FIGS. 14A and 14B, the sampling module comprises four injection interfaces 1454A-D, disposed at the extremity of the four peripheral injections flow lines 1424A-D, and one sampling interface 1453, disposed at the extremity of one central sampling flow line 1423. A power source 1410 is electrically coupled to the four injection interfaces 1454 A-D and the sampling interface 1453 for generating an electromagnetic field in the formation. While four peripheral injection interfaces and one central sampling interface are shown in FIGS. 14A-B, there could be however a different number of sampling and/or injection interfaces. Furthermore, the sampling interface may include a guard probe having sample and clean-up flow lines.

The electromagnetic field generated in the formation by the power source 1410 is used to produce or generated heat in a portion of the formation by dielectric heating, or microwave heating of the molecules in the formation, as detailed below.

The electromagnetic wave generated by the power source 1410 penetrates in the formation. The depth of penetration of the electromagnetic wave in the formation may be determined by Equation 4:

$$\delta=1/\sqrt{\pi\mu'\sigma'f}. \tag{4}$$

where $\sigma'$ and $\mu'$ are respectively the electrical conductivity and magnetic permeability of the portion of the formation located next to the sampling module. Equation 4 shows the depth of field penetration decreases according to $f^{-1/2}$. Thus, in a formation of conductivity 0.01 $Sm^{-1}$ the penetration depth of an electromagnetic wave at a frequency of 100 MHz is about 0.5 m while the penetration depth of an at electromagnetic wave at 10 kHz the about 50 m.

Then, the electromagnetic radiation may be absorbed by the hydrocarbon, connate water or injected fluid by dipole relaxation. The electromagnetic absorption varies with the properties of irradiated fluid, more particularly with the complex relative electric permittivity of the irradiated fluid given by $\in_r = \in' - i \in''$. The real part of the complex relative electric permittivity, which can depend on frequency, is the dielectric constant $\in'$ while the imaginary part, $\in'' = \sigma/(\omega \in_0)$ accounts for electrical dissipation within the irradiated fluid of electrical conductivity $\sigma$. The imaginary part $\in''$ and Equation 4 determines the absorption coefficient $\alpha_e$ of the electromagnetic field through Equation 5:

$$\alpha_e^2 = \frac{(2\pi f)^2 \mu' \varepsilon'}{2} \left\{ \left( 1 - \left[ \frac{\sigma}{\varepsilon' 2\pi f} \right] \right)^{1/2} - 1 \right\} \quad (5)$$

which shows that the absorption coefficient $\alpha_e$ may increase with increasing frequency. More particularly, the absorption coefficient $\alpha_e$ is the reciprocal of the penetration depth and is about two orders of magnitude smaller when the frequency decreases from 0.1 GHz to 10 kHz, assuming the complex permittivity is constant.

Thus, the model described by Equations 4 and 5 (or any other model) may be used to advantage to select a frequency for the power source 1410. The selection may optimize the depth of penetration and consequently the volume heated by the electromagnetic wave. The selection may alternatively or additionally optimize the absorption coefficient and consequently the speed at which the temperature is increased in the formation.

Although example methods, apparatus, and articles of manufacture have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A method for sampling fluid in a subterranean formation, comprising:

producing heat in a portion of the subterranean formation by at least one of an ohmic heating and a dielectric heating;

injecting a displacement fluid into the heated portion of the subterranean formation, the displacement fluid pressurizing the heated portion of the subterranean formation;

monitoring a pressure applied by the displacement fluid on formation fluid in the heated portion of the subterranean formation, a decrease in the pressure indicating a corresponding decrease in a viscosity of the formation fluid; and collecting a sample of the formation fluid mobilized by the displacement fluid from the heated portion of the subterranean formation via at least one formation interface.

2. The method as defined in claim 1, further comprising detecting the viscosity of a fluid in the heated portion via performing a nuclear magnetic resonance measurement.

3. The method as defined in claim 1, wherein collecting the sample of fluid comprises collecting the sample of fluid prior to the displacement fluid entering the at least one formation interface.

4. The method as defined in claim 1, wherein the displacement fluid comprises at least one of nitrogen, carbon dioxide, steam or dibromethane.

5. The method as defined in claim 1, wherein injecting the displacement fluid into the heated portion of the subterranean formation comprises operating a pressurization device of a downhole tool, wherein the downhole tool further comprises the at least one formation interface.

6. The method of claim 5 wherein the downhole tool further comprises an internal collection container, and wherein collecting the sample of mobilized fluid comprises:

hydraulically coupling the at least one formation interface to the subterranean formation; and receiving the sample in the collection container of the downhole tool.

7. The method as defined in claim 6, wherein the collection container comprises a sampling piston configured to reduce a parasitic volume of sampling fluid associated with the at least one formation interface.

8. The method of claim 5 wherein producing heat in the portion of the subterranean formation comprises operating a power source of the downhole tool to induce the at least one of ohmic heating and dielectric heating.

* * * * *